United States Patent [19]

Katzman

[11] Patent Number: 4,852,796

[45] Date of Patent: Aug. 1, 1989

[54] DISPLAY CONTAINER

[75] Inventor: Abe Katzman, Scarsdale, N.Y.

[73] Assignee: General Motors Corporation, Detroit, Mich.

[21] Appl. No.: 208,238

[22] Filed: Jun. 17, 1988

Related U.S. Application Data

[63] Continuation-in-part of Ser. No. 98,069, Sep. 18, 1987, Pat. No. 4,775,097.

[51] Int. Cl.[4] ..... B65D 5/30; B65D 5/48

[52] U.S. Cl. ..... 229/125.28; 229/23 BT; 229/125.32

[58] Field of Search ..... 229/23 BT, 125.28, 125.32, 229/160; 206/44 R, 45.14

[56] References Cited

U.S. PATENT DOCUMENTS

| | | | |
|---|---|---|---|
| 1,357,519 | 11/1920 | Russell | 229/125.32 |
| 2,304,362 | 12/1942 | Haye | 229/125.28 |
| 3,276,662 | 10/1966 | Farguhar | 229/125.32 |
| 3,286,901 | 11/1966 | Anderson | 229/23 BT |
| 3,451,535 | 6/1969 | Caplan | 229/16 D |
| 3,810,573 | 5/1974 | Russell et al. | 229/23 BT |
| 3,951,329 | 4/1976 | Turner | 229/125.32 |
| 4,133,430 | 1/1979 | Cravens | 229/23 BT |
| 4,775,097 | 10/1988 | Katzman | 229/23 BT |

FOREIGN PATENT DOCUMENTS

| | | | |
|---|---|---|---|
| 1330322 | 9/1973 | United Kingdom | 229/23 BT |

*Primary Examiner*—Gary Elkins
*Attorney, Agent, or Firm*—R. L. Phillips

[57] ABSTRACT

A display container comprising a base having bottom, side and end walls, as well as a lid having a lower end telescopically engaged into the base. The lid has top, side and end walls. The upper portions of the side walls of the lid which are not within the base have outer surfaces which are co-planar with the outer surfaces of the base side walls so that a smooth, flush and continuous path is established around the lid and base which can receive tape or other packaging material for fastening the lid to the base. A divider assembly is enclosed within the telescopically engaged lid and base for providing separate compartments within the display container. The lid end walls can cover at least part of the upper edge of the base end walls.

7 Claims, 8 Drawing Sheets

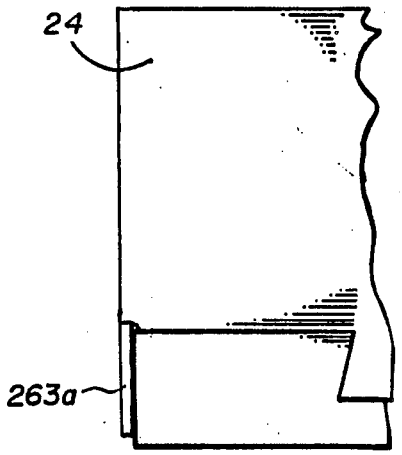
FIG. 13
FIG. 14
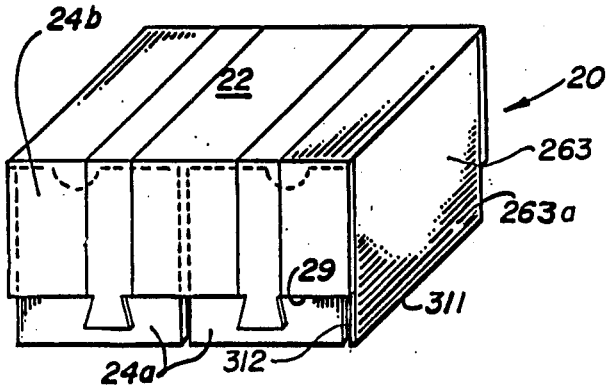

DISPLAY CONTAINER

CROSS REFERENCE TO RELATED APPLICATION

The present application is a continuation-in-part application of Ser. No. 098,069, filed Sept. 18, 1987, now U.S. Pat. No. 4,775,097 issued 10/4/88.

BACKGROUND OF THE INVENTION

The present invention relates in general to fibreboard containers and, in particular, to a new and useful display container which has top, bottom and opposite side walls with smooth flush outer surfaces, so that a smooth continuous loop of packing tape can be provided around the container in a convenient and attractive manner.

Containers are known which have two top and bottom portions which are telescopically engaged with each other. If one part is only partly telescopically engaged into the other, leaving an exposed portion, no continuous smooth pathway can be provided around the container for sealing the two parts together. This is because one part must necessarily have smaller dimensions than the other to establish the telescopic engagement.

SUMMARY OF THE INVENTION

An object of the present invention is to provide a display container which has a base that telescopically receives a lid, with upper portions of the lid exposed and which still provides a continuous, smooth and flush pathway around the entire container to receive a smooth loop of tape or other packing material.

Another object of the present invention is to provide a display container having telescopically engaged base and lid, and which contains a divider assembly for attractively and conveniently separating items within the container.

The base comprises bottom, side and end walls which define a space having an open top. The lid has top, side and end walls which define an enclosure and have an open bottom. Lower portions of the lid, side and end walls are telescopically engaged into the base, leaving upper portions of the lid exposed. The side walls of the lid have outer panels which are co-planar with outer surfaces of the base side wall, so that a continuous, smooth and flush pathway is provided entirely around the container, along the outer surfaces of the top and bottom walls and along the outer surfaces of the lid and base side wall.

The divider assembly comprises one or more dividers, each having a first rectangular member, having a pair of center panels which are folded to be upright, and a pair of end panels which extend outwardly from the center panels with a second rectangular member, with a rectangular center panel overlying a central portion of the upright center panels of the first rectangular member, the second rectangular member having end panels engaged by a slot arrangement into the center panels of the first rectangular member. In this way, six compartments are formed by each divider.

BRIEF DESCRIPTION OF THE DRAWINGS

In the accompanying drawings, forming a part of this specification, and in which reference numerals shown in the drawings designate like or corresponding parts throughout the same.

FIG. 13 is a fragmentary side elevational view of another embodiment of the invention; and FIG. 14 is a perspective view of a lid according to the embodiment of FIG. 13.

DETAILED DESCRIPTION

Figure 1:
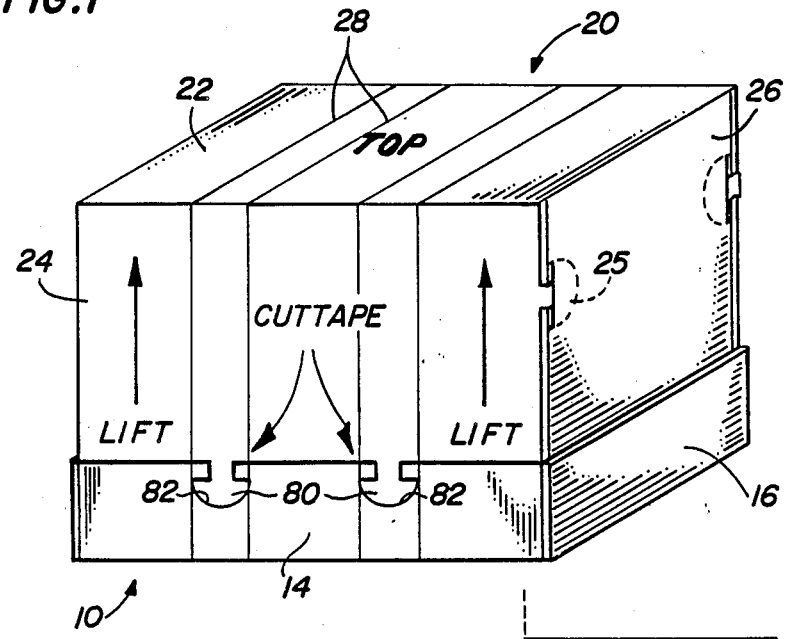
FIG. 1 is a front perspective view of the display container in accordance with the present invention with the lid telescopically engaged into the base.

Referring to the drawings in particular, the invention embodied in FIG. 1 comprises a display container having a base generally designated 10, having a lid generally designated 20, with a lower end telescopically engaged into the base.

Figure 4:
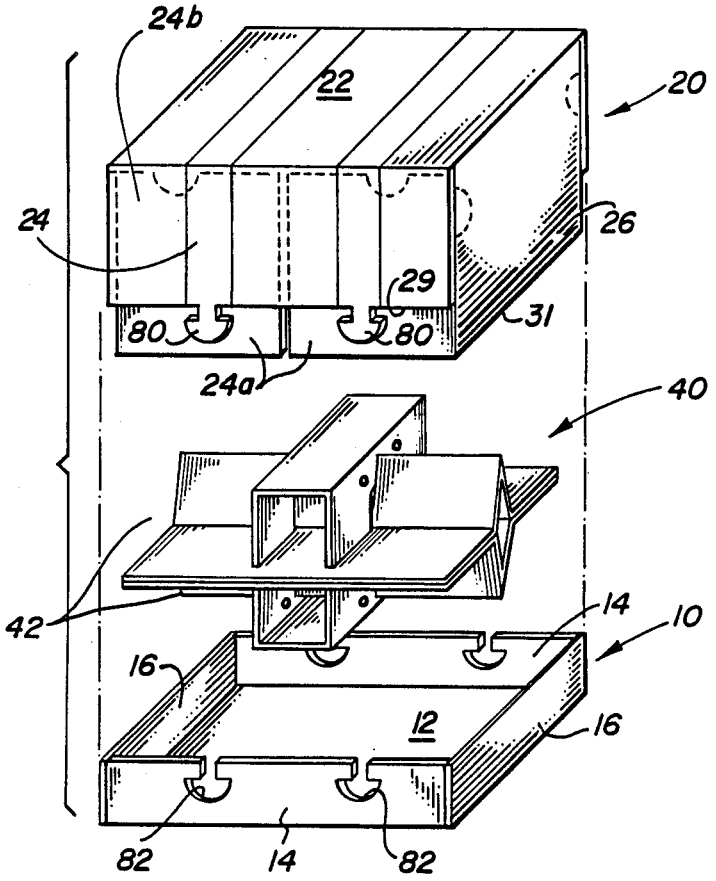
FIG. 4 is an exploded perspective view of the lid, base and divider assembly of the present invention.

As best shown in FIG. 4, the base comprises a bottom wall 12, two side walls 14 and two end walls 16, and defines an enclosure with an open top. The lid 20 has a top wall 22, two side walls 24 and two end walls 26 which together form an enclosure having an open bottom (which is not visible in FIG. 4).

A divider assembly 40 having upper and lower dividers 42 forms twelve partitioned areas for receiving merchandise. To assemble the display container, the divider assembly 40 is inserted into the base 10. In this position, the entire upper divider 42 is fully exposed and about one half of the lower divider 42 is also exposed.

In this positon, for the divider assembly and base, the lid 20 can be lowered and telescopically engaged over the divider assembly 40 and partly into the base 10.

The lid end walls 26 are made of single panels having co-planar upper and lower portions. Only the lower portion of each end panel 26, however, is engaged into the base end and behind a respective base side wall 16. The combined side wall of the display container thus does not present a smooth flush surface, but rather a step is formed between the outer surface of base end wall 16 and the upper portion of lid end wall 26.

Figure 2:
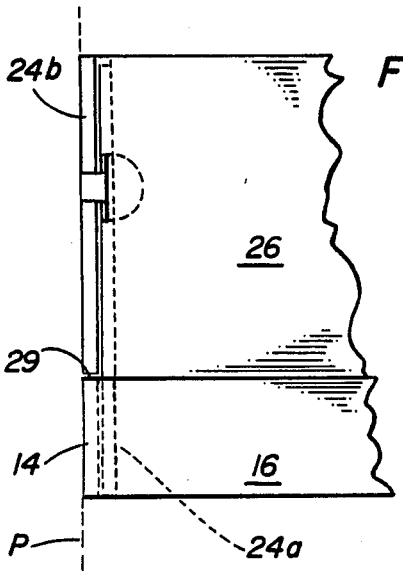
FIG. 2 is a fragmentary side elevational view of FIG. 1, showing the co-planar nature of the outer surfaces of the lid and base side wall.

The lid side walls 24, however, have an inner portion **24*a* which extends below an outer portion 24*b* thereof, and which is telescopically engaged into the base 10 and behind respective base side walls 14. The outer portion 24*b* of the side wall 24 has a lower edge which abuts against the upper edge of the base side wall 14. As shown in FIG. 2, outer surfaces of the outer portion 24*b*** and the base side wall 14 can thus be co-planar on a plane P. The same is true of the opposite side wall which is not shown in FIG. 1.

In this way, a smooth, continuous and flush surface loop can be established entirely around the display container over the top and bottom surfaces thereof and over the flush planes P, over the side walls thereof. For convenience to the user of the display container, two pairs of printed tracks 28 can be printed onto the outer surfaces of the lid and base to provide a clear indication of where loops of packing tape should be provided.

Figure 3:
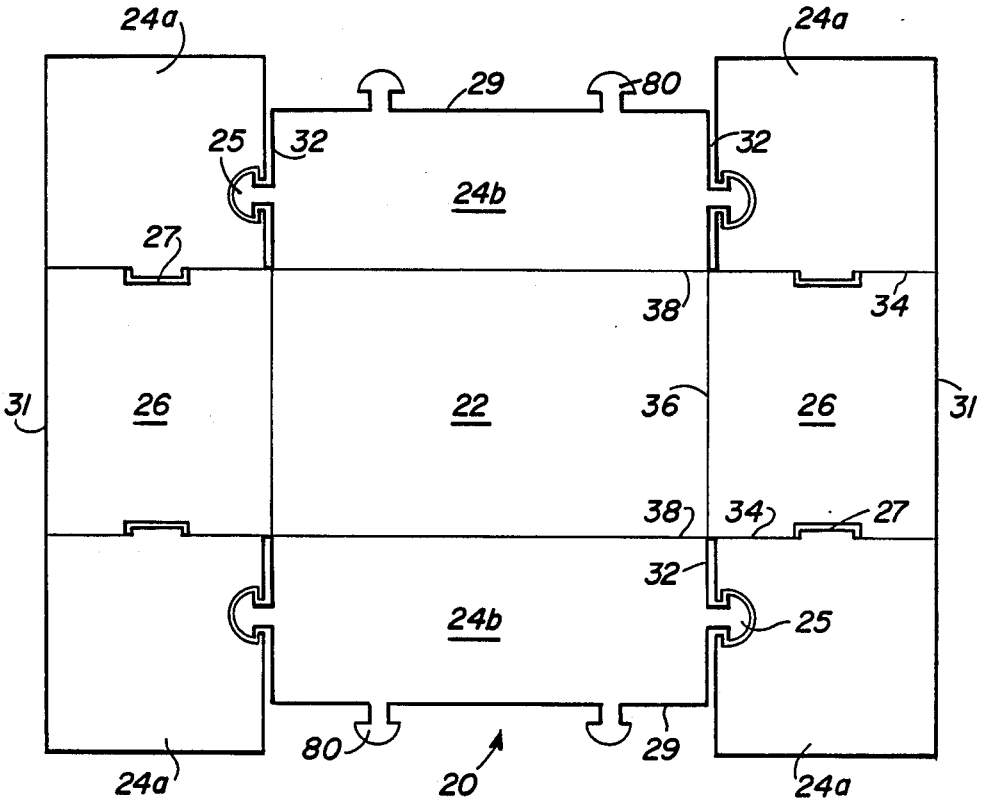
FIG. 3 is a plan view of a blank used to form the lid of the container in FIG. 1.

Referring to FIG. 3, lid 20 is formed by a blank, having a top panel for forming the top wall 22 which is connected at fold lines 38 to a pair of panels forming the outer portion 24*b* of the lid side walls. Top wall panel 22 is also connected at fold lines 36 to a pair of end wall panels for forming the end walls 26. Each end wall panel 26 is connected at fold lines 34 to a pair of panels which each form one half of the inner side wall 24*a*.

Cuts 32 separate panels 24*b* from panels 24*a*. Each panel 24*b* also includes a pair of tabs 26 which are cut out from the material of the panels 24*a*. In the folded position shown, for example, in FIG. 1, each tab 25 is inserted into a slot 27 provided near the fold line 34 between panels 26 and 24*a*.

As can be seen in FIG. 3, the width of outer wall portion panels 24*b* from fold line 38 to a lower edge 29 of the panel, is less than the width of the end wall panels 26 from their fold lines 36 to their outer edge 31. In this way, with the lid folded, lower portions of inner wall panels 24*a* and lower portions of end wall panels 26 extend below the lower edges 29 of the outer side wall panels 24*b*.

Outer edges 31 of combined panels 24*a*, 26, at opposite ends of the blank shown in FIG. 3, preferably abut against the bottom wall 12 when the lid is fully telescoped down into the base.

Figure 5:
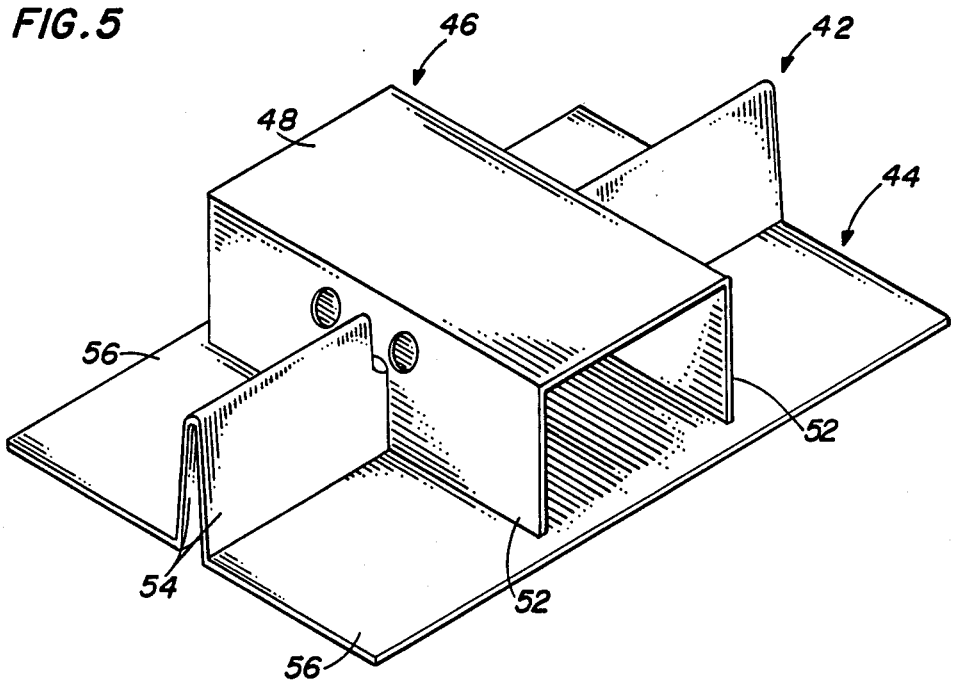
FIG. 5 is a perspective view of one divider of the divider assembly shown in FIG. 4.
Figure 6:
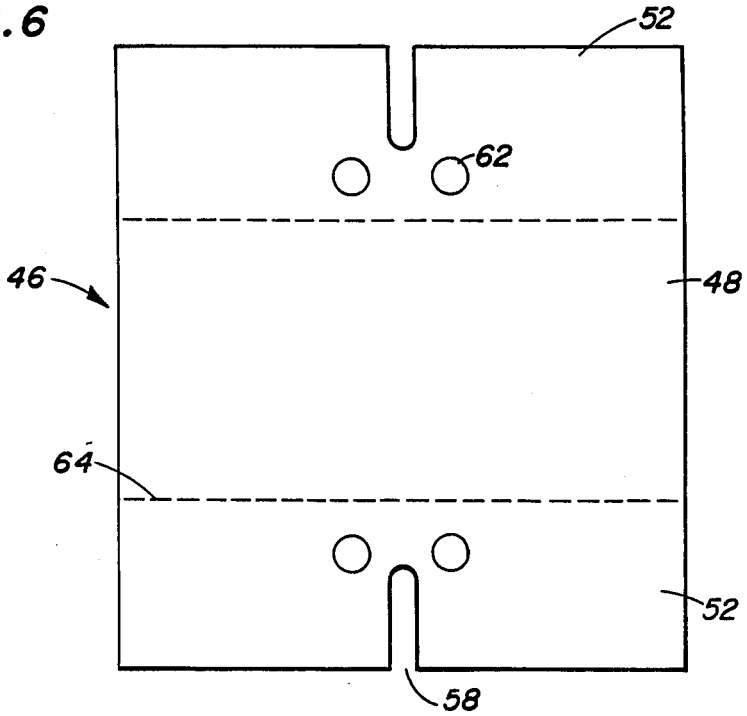
FIG. 6 is a plan view of a blank for forming one member of the divider.
Figure 7:
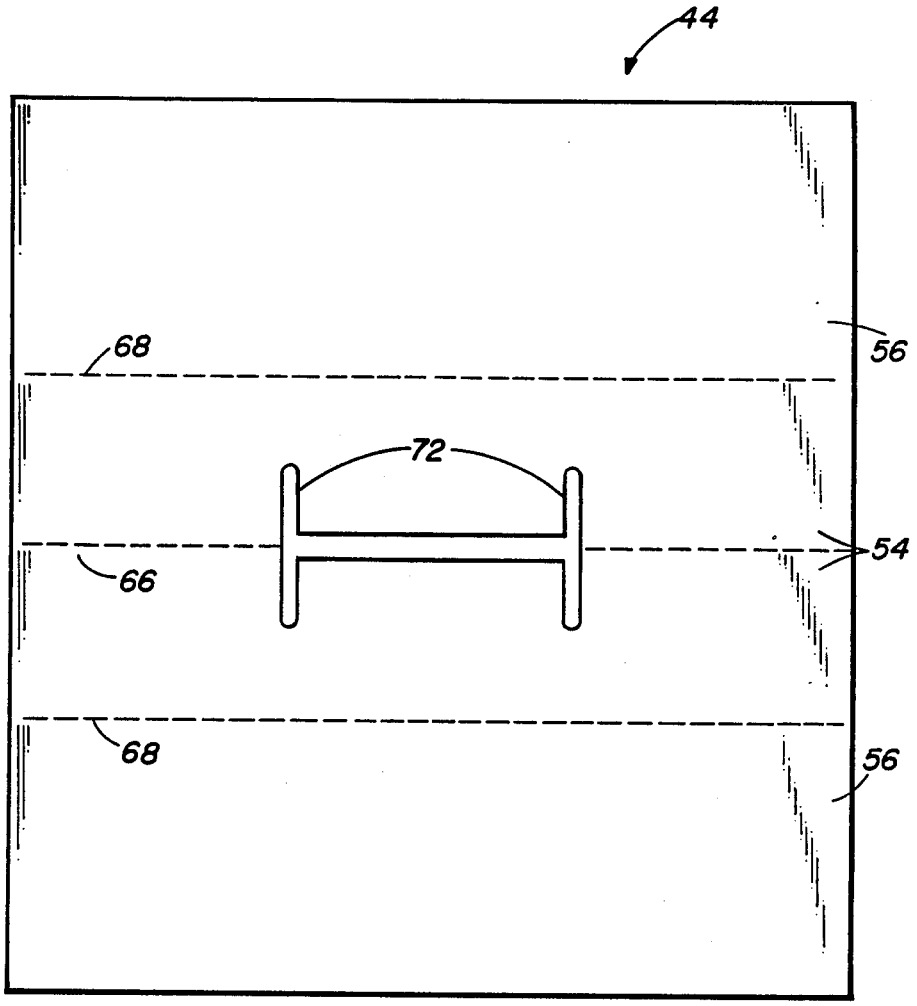
FIG. 7 is a plan view of a blank for forming the other member of the divider.

Turning now to FIGS. 5 through 7, the divider 42 comprises a first rectangular member 44 which is engaged with a second rectangular member 46. As shown in FIG. 7, the first rectangular member 44 is made of a rectangular blank having a pair of center panels 54 which are connected to each other at a fold line 66 and which include an H-shaped slot 72. End panels 56 are connected at fold lines 64 to outer edges of the center panels 54. FIG. 6 shows the second rectangular member 46 which has a center panel 48 connected at fold lines 64 to end panels 52. Each end panel 52 has a slot 58, as well as a pair of holes 54.

FIG. 5 shows the first and second members folded and engaged with the slots 58 seated into parts of the slots 72 to form six partitioned compartments. Holes 62 are provided as finger holes to aid in the movement and manipulation of the dividers 42.

Figure 8:
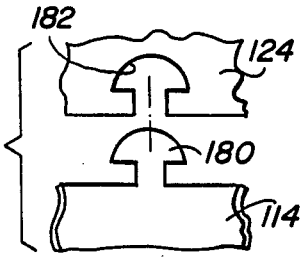
FIG. 8 is a fragmentary view showing an alternate embodiment for the locking mechanism between the lid and the base.

Another advantageous feature of the invention is the use of locking tabs shown at 80 in FIGS. 1, 3 and 4 which can be formed at the edges 29 of the lid blank. These are inserted into exactly conforming recesses 82 in the side wall 14 of the base 10. This arrangement can act as a locking mechanism between the lid and the base independently, or in addition to the use of wrapping tape or the like. FIG. 8 shows a modified version where a lid having a side wall 124 has a recess 182 which corresponds to and receives a locking tab 180 projecting upwardly from the side wall 114 of a base.

The locking tab lies flush in its recess for both embodiments of FIG. 1 and 8.

In FIGS. 9 through 14, the same reference numerals are utilized to designate the same or similar parts. In the embodiments of FIGS. 9 through 14, an alternate and potentially stronger locking mechanism is disclosed for locking the lid to the base and means are also provided for covering at least part of the upper edge of the base end walls to avoid the temptation of moving or lifting the display container by engaging the upper edge of the base end walls.

Figure 9:
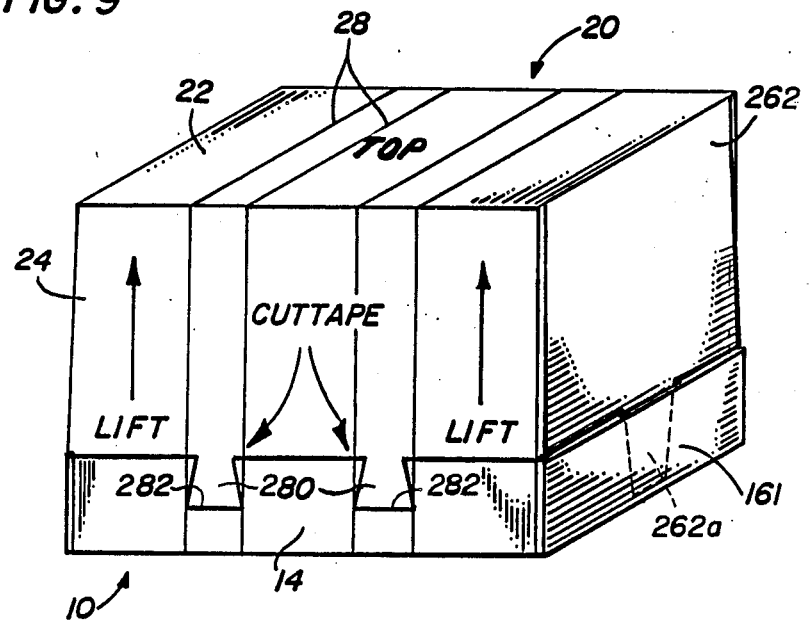
FIG. 9 is a view similar to FIG. 1, showing a still further embodiment of the invention.
Figure 10:
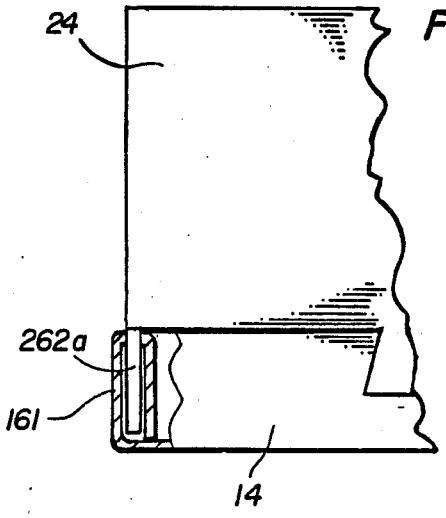
FIG. 10 is a fragmentary side elevational view partly in section of the embodiment of FIG. 9.
Figure 12:
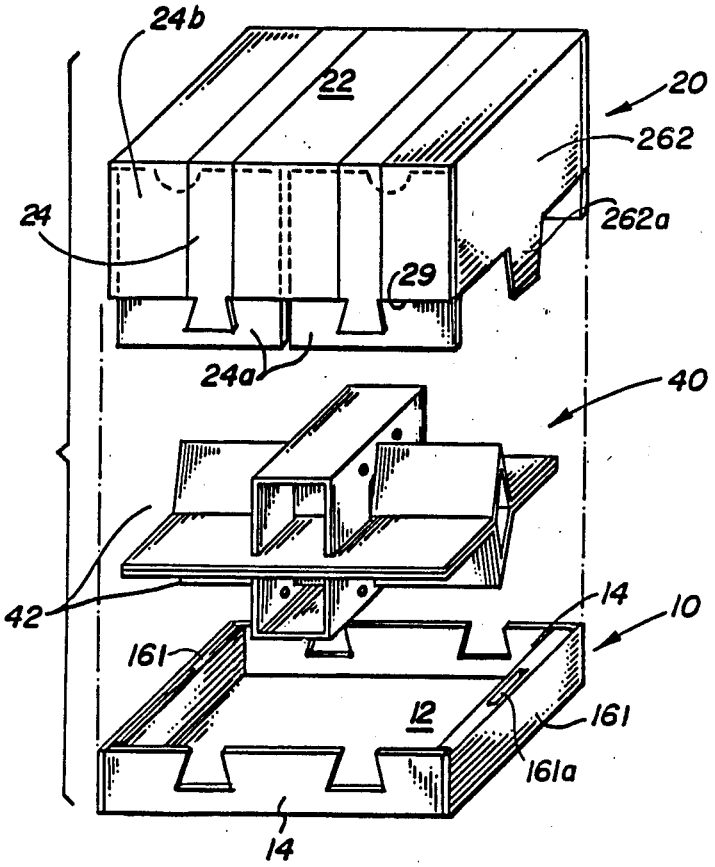
FIG. 12 is a view similar to FIG. 4 illustrating the embodiment of FIG. 9.

In FIG. 9, lid 20 comprises lid end walls 262 having a lower portion in the form of an end wall tab 262*a* which extends into a slot at the top of the base end wall 161. As shown in FIG. 10, to accomodate lower end wall tab 262*a*, base end wall 161 is made of two thicknesses of panel material. By centrally engaging tab 262*a* between the two panel material portions of base end wall 161, access to the upper edge of the base end wall 161 is effectively precluded. Slot 161*a*, as shown in FIG. 12, is advantageously centered in the width and length of the upper edge of end wall 161. End wall tab 262*a* is also advantageously tapered in a downward direction to facilitate entry into slot 161*a*.

The locking mechanism in the embodiment of FIGS. 9, 10 and 12 also comprises pairs of wedge-shaped, downwardly expanding locking tabs 280, which extend downwardly from the lower edge of the outer portion of lid side wall 24 and which engage into correspondingly shaped, locking tabs 282 in the base side walls 14.

Figure 11:
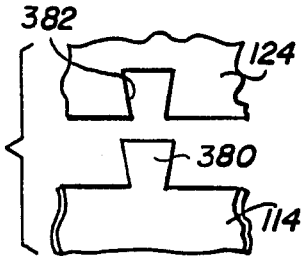
FIGS. 11 and 11A are partial views of alternate locking mechanisms for the embodiment of FIG. 9.
Figure 11A:
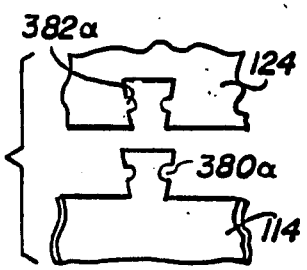

An alternate embodiment of the locking mechanism is shown in FIG. 11, where wedge-shaped locking tabs 380 extend upwardly from base side walls 114 and extend into correspondingly shaped recesses 382 in the upper portion of lid side walls 124. FIG. 11A shows another version, which includes side projection 382*a*, which fit side recesses 380*a* of tabs 380. These can also be used on the locking mechanism of FIGS. 9 and 12.

FIG. 13 and 14 show a still further embodiment of the invention, wherein the lower portion 263*a* of the lid end walls 263 extends the full width of the lid end walls and fully engages over the outer surface of the base end walls to completely cover the upper edge of the base end walls. To permit the inner portions 24*a* of the lid side walls 24 to telescope into and behind the base side walls, while at the same time permitting the lower portions 263*a* to cover the base end walls, a slot 312 is provided at each corner of lid 20 to separate the side wall from the end wall in the vicinity of lower portion 263*a*. The lower edge 311 of the lid end wall 263 extends substantially to the lower surface of the base so as to substantially cover the end wall of the base.

I claim:

1. A display container comprising:

a base having a bottom wall, two side walls, two end walls and an open top, said side and end walls having upper edges;

a lid having a top wall, two side walls, two end walls and an open bottom;

said lid end walls having lower portions engagable over at least part of respective base end walls, and at least partly covering said base end wall upper edges, said lid side walls having inner portions which are telescopically engagable into said base behind respective base side walls;

each lid end wall having an upper portion with an outer surface, which is co-planar with an outer surface of its respective lower portion, each lid side wall having an outer portion over a respective base side wall, said outer portion of each lid side wall having an outer surface which is co-planar with an outer surface of its respective base side wall, whereby tape can be smoothly wrapped in a continuous loop over outer surfaces of said top, bottom and base side walls, as well as over said outer surfaces of said outer portion of said lid side walls; and one of said lid and base including a wedge-shaped, locking tab and the other of said lid and base includes a locking recess having a shape corresponding to that of said locking tab for receiving said locking tab to lock said lid to said base.

2. A display container according to claim 1, wherein said lower portions of said lid end walls each comprise a tab, each of said base end walls having a slot in its upper edge for receiving said tab.

3. A display container according to claim 2, wherein said tab and slot are substantially centrally located on said lid and base end walls.

4. A display container according to claim 2, wherein said base end walls are each made of a double thickness of material, said slot and said tab being positioned between said double thickness of material.

5. A display container according to claim 1, wherein said lower portions of said lid end walls are separated from said lid side walls by slots, said lower portions of said lid end walls telescopically overlying outer surfaces of respective base end walls.

6. A display container according to claim 5, wherein said lower portions of said lid end walls substantially cover said respective base end walls.

7. A display container comprising:

a base having a bottom wall, two side walls, two end walls and an open top, said side and end walls having upper edges;

a lid having a top wall, two side walls, two end walls and an open bottom;

said lid end walls having lower portions engagable over at least part of respective base end walls, and at least partly covering said base end wall upper edges, said lid side walls having inner portions which are telescopically engagable into said base behind respective base side walls;

each lid end wall having an upper portion with an outer surface, which is co-planar with an outer surface of its respective lower portion, each lid side wall having an outer portion over a respective base side wall, said outer portion of each lid side wall having an outer surface which is co-planar with an outer surface of its respective base side wall, whereby tape can be smoothly wrapped in a continuous loop over outer surfaces of said top, bottom and base side walls, as well as over said outer surfaces of said outer portion of said lid side walls; and said lid being made of a blank comprising a top panel forming said top wall having two side edges and two end edges, an end panel connected at a fold line to each end edge of said top panel, each end panel having opposite side edges, an inner side panel connected at a fold line to each side edge of each end panel and an outer side panel connected at a fold line to each side edge of said top panel, each of said end panels with their attached inner side panels having a co-linear outer edge spaced away from said top panel and each other side panel having an outer edge spaced away from said top panel, the width of each outer side panel between said top panel and its outer edge being less than the width of each end panel between said top panel and its outer edge.

* * * * *

UNITED STATES PATENT AND TRADEMARK OFFICE

CERTIFICATE OF CORRECTION

PATENT NO. : 4,852,796

DATED : August 1, 1989

INVENTOR(S) : Abe Katzman

It is certified that error appears in the above-identified patent and that said Letters Patent is hereby corrected as shown below:

Title page, item [73], delete all reference to assignee.

Attorney, Agent, or Firm -

Change "R.L. Phillips" to --Notaro & Michalos P.C.--

Signed and Sealed this

Seventeenth Day of April, 1990

*Attest:*

HARRY F. MANBECK, JR.

*Attesting Officer*

*Commissioner of Patents and Trademarks*